US007104017B1

(12) United States Patent
Kadotani et al.

(10) Patent No.: US 7,104,017 B1
(45) Date of Patent: Sep. 12, 2006

(54) BOX GIRDER STRUCTURE FOR BRIDGE PROVIDED WITH OUTER CABLE AND METHOD OF BUILDING THE BOX GIRDER

(75) Inventors: Tsutomu Kadotani, Atsugi (JP); Norio Terada, Sagamihara (JP); Yoshitaka Nishida, Kobe (JP); Takashi Takagaki, Takarazuka (JP); Toshikazu Minami, Kobe (JP)

(73) Assignees: Anderson Technology Corporation, Tokyo (JP); Sumitomo Electric Industries, Ltd., Osaka (JP); Shinko Wire Company, Ltd., Hyogo (JP); Berger/ABAM Engineers, Inc., Federal Way, WA (US)

( * ) Notice: Subject to any disclaimer, the term of this patent is extended or adjusted under 35 U.S.C. 154(b) by 0 days.

(21) Appl. No.: 09/571,321

(22) Filed: May 15, 2000

(30) Foreign Application Priority Data

May 17, 1999 (JP) ..... 11-135878
Apr. 14, 2000 (JP) ..... 2000-114353

(51) Int. Cl.
*E04C 5/08* (2006.01)

(52) U.S. Cl. ..... 52/223.8; 52/223.14

(58) Field of Classification Search ..... 52/223.8, 52/223.3, 223.1, 223.4, 223.5, 223.9, 223.14, 52/233, 231; 264/228, 229, 221; 174/102 C, 174/107, 110 R, 110 S, 110 N
See application file for complete search history.

(56) References Cited

U.S. PATENT DOCUMENTS 3,791,092 A * 2/1974 Schmitter ..... 52/378
4,848,052 A 7/1989 Nutzel
4,878,327 A 11/1989 Nutzel et al.
4,999,959 A * 3/1991 Virtanen ..... 52/230
5,437,072 A * 8/1995 Dinis et al. ..... 14/73
5,540,030 A * 7/1996 Morrow ..... 52/742.13
5,573,852 A 11/1996 Thal
5,713,162 A * 2/1998 Gallo et al. ..... 52/167.1
5,904,765 A 5/1999 Dugat
5,924,250 A * 7/1999 Jungwirth et al. ..... 52/223.9
6,389,764 B1 * 5/2002 Stubler et al. ..... 52/220.8

FOREIGN PATENT DOCUMENTS

EP 0207337 * 1/1987

* cited by examiner

*Primary Examiner*—Naoko Slack
*Assistant Examiner*—Chi Q. Nguyen
(74) *Attorney, Agent, or Firm*—James H. Wynn; Roberta L. Hastreiter; Lord, Bissell & Brook LLP

(57) ABSTRACT

Outer cables disposed in a box girder in the longitudinal direction of a box girder bridge to prestress the box girder each have a transparent sheath made of a transparent polyethylene resin, vinyl chloride resin, polypropylene resin or the like, thereby allowing the grouting condition in the sheath to be inspected reliably and easily. If a colored grout is filled, the filling condition can be inspected even more reliably and easily. In addition, it is possible to readily find a portion left unfilled after the grout has hardened and to refill it for repairing by using openings for injection and ejection made at each side of the void left.

12 Claims, 6 Drawing Sheets

BOX GIRDER STRUCTURE FOR BRIDGE PROVIDED WITH OUTER CABLE AND METHOD OF BUILDING THE BOX GIRDER

TECHNICAL FIELD

The present invention relates to a box girder structure for a bridge provided with outer cables and also relates to a method of building the box girder. More particularly, the present invention relates to a box girder structure including outer cables used to a prestressed concrete box girder of a bridge, the outer cables being improved so that grout can be fully filled in the sheaths of the outer cables surely and easily. The present invention also relates to a method of building the box girder.

BACKGROUND ART

Prestressed-concrete structures built by the post-tensioning system include an inner-cable structure in which tendons, e.g. prestressing steel wires or steel strands, covered with sheaths are provided within a concrete member. In such an inner-cable structure, when a grout is filled in the sheaths after prestressing has been done, it is extremely difficult to detect the filling condition of the grout.

In compliance with the demand for a reduction in weight of prestressed-concrete box girders, an "outer-cable structure" has been adopted to reduce the wall thickness of box girder members, in which prestressing tendons are provided out of the concrete members in cross-section of the girder (i.e. in the space inside the box girder cross-section).

The use of the outer-cable structure allows the box girder itself to be reduced in weight and also permits a reduction in material cost and a reduction in work volume required for construction, plus enabling the maintenance and repair of prestressing cables, advantageously. In addition, the reduction in weight of the superstructure leads to a reduction in cost of the substructure (the foundation and piers of a bridge) supporting the superstructure.

In the outer-cable structure, a prestressing tendon that is made up of a large number of prestressing steel wires or steel strands is inserted into a sheath to form an outer cable.

As in the case of the inner-cable structure, tensile stress is applied to the tendon at anchorages provided at both ends of the box girder through anchoring devices to induce compressive stress (prestress) in the concrete girder, thereby improving the load-carrying capacity of the whole box girder.

In the outer cable, a steel pipe or a black polyethylene pipe is generally used as a sheath from the viewpoint of durability. The black polyethylene pipe is formed by mixing an ordinary polyethylene component with carbon black or the like to blacken the polyethylene pipe for the purpose of preventing the material from being deteriorated by ultraviolet exposure.

Incidentally, tendons, which are made of steel, must be subjected to anti-corrosion treatment because of its property. To carry out anti-corrosion treatment for the tendon in the sheath of each outer cable installed in a box girder at a bridge construction site, cement milk or a resin- or oil-based filler is injected into vacant spaces in the sheath as a grout.

Above all, cement milk is a strongly alkaline inorganic grout. Therefore, if cement milk is satisfactorily filled to enclose prestressing steel or the like, which is sensitive to stress corrosion, best durability is exhibited, and high reliability is obtained.

In general, a grout is injected into the sheath by a grout pump from a grout injection hole provided in the anchorage at one end of the sheath, and it is judged that filling of the grout has been completed when the grout has reached the anchorage at the other end of the sheath.

On this occasion, the filling condition of the grout injected into the sheath can be confirmed only indirectly by making a visual check as to whether or not excess grout has been discharged from the upper ends of discharge hoses provided at several positions in an intermediate portion of the sheath. There has heretofore been no technique for directly and reliably confirming or inspecting the filling condition of the grout in the sheath.

There are some advantages in adopting the outer-cable structure for a box girder bridge: reduction in weight of the concrete member; reduction in time and labor required for steel assembling and concrete placing operations; ease of replacing prestressing steel; and ease of improving an existing bridge in maintenance plus load-carrying capacity. To allow these advantages to be surely exhibited, a design of high accuracy and a reliable operation are required at each step of the outer cable installing operation. Above all, an operation of injecting a grout into a sheath enclosing a tendon is one of important factors influencing the performance of a structure with outer cables.

The object in injecting a grout into the sheath of an outer cable is to fill vacant spaces in the sheath with a homogeneous grout and to enclose a tendon made of prestressing steel or the like satisfactorily, thereby taking anti-corrosion measures. That is, in the grout injection operation, reliable and elaborate filling is important. In the conventional method, however, a black polyethylene pipe or a steel pipe is used as a sheath pipe, and it is therefore difficult to inspect or confirm the filling condition of the grout either during or after the grouting operation. In particular, the filling condition of the grout cannot readily be confirmed or inspected by visual observation. Accordingly, the conventional method suffers from serious problems in terms of reliability and so forth.

There has also been proposed a method of inspecting the filling condition of the grout in which ultrasonic waves are transmitted from one end of a sheath at an anchorage and received at the other end to detect an abnormality when the filling is insufficient [for example, see Japanese Patent Application Unexamined Publication (KOKAI) No. 4-182568]. There has also been proposed a method in which elastic waves are propagated from the sheath surface, and the filling condition of the grout is detected from the way in which the elastic waves are received [for example, see Japanese Patent Application Unexamined Publication (KOKAI) No. 10-54140]. However, it cannot be denied that any of the conventional methods involves problems in terms of practicality, e.g. difficulty in installing terminals for transmission and reception, and need of an advanced measuring device and a high level of signal analyzing capacity.

Moreover, outer cables are designed so that they are not only disposed in parallel longitudinally in a box girder but also caused to change in direction vertically by deflectors provided in the box girder. This is done to prestress the box girder not only in the longitudinal direction but also in the vertical direction so as to cope with various stresses induced in the whole concrete structure. Recently, however, size of a tendon has been increased so as to reduce costs of labor relative to post-tensioning operation including pre and post works such as placing ducts and injecting grout. The use of outer cables with an increased outer diameter requires a special consideration to be given to the deflector structure.

That is, it is desirable to provide a structure in which the cable surface and the contact surface of each deflector should rub against each other smoothly without producing unnecessary frictional force transmitted through contacting pressure occurring at the deflector to the concrete structure. Accordingly, it has been desired eagerly that outer cables should be capable of meeting such a structural demand appropriately.

It will be apparent that the above-described outer cable structure is applicable not only to concrete box girders but also to steel box girders.

DISCLOSURE OF INVENTION

An object of the present invention is to provide a technique whereby the filling condition of a grout in the sheath of an outer cable can be observed reliably and easily.

To solve the above-described problem, the present invention provides the following.

(1) A box girder structure including outer cables disposed in a box girder of a box girder bridge to prestress the box girder, the outer cables each having a transparent sheath.

(2) A box girder structure as stated in the above paragraph (1), wherein the sheath covers the outer cable and makes it possible to perform reliably and readily through visual observation an operation selected from the group consisting of inspection during injection of a grout into the sheath, inspection of the condition in the sheath and refilling of the grout into a vacant space in the sheath.

(3) A box girder structure including outer cables disposed in a box girder of a box girder bridge to prestress the box girder, the outer cables each having a transparent sheath injected with a colored grout.

(4) A box girder structure as stated in the above paragraph (3), wherein the sheath covers the outer cable and makes it possible to perform reliably and readily through visual observation an operation selected from the group consisting of inspection during injection of the grout into the sheath, inspection of the condition in the sheath and refilling of the grout into a vacant space in the sheath.

(5) A box girder structure as stated in any of the above paragraphs (1) to (4), wherein the transparent sheath is made of a material selected from the group consisting of a polyethylene resin material, a vinyl chloride resin material, a polypropylene resin material, a polycarbonate resin material and a Teflon resin material, or a composite material consisting of two or more of these materials.

(6) A box girder structure as stated in any of the above paragraphs (1) to (5), wherein transparent sheathing is directly cast in concrete of the deflector or curved steel pipes are provided in deflectors to dispose the outer cables.

(7) A box girder structure as stated in the above paragraph (6), wherein the curved steel pipes each have an inner surface coated with polyethylene.

(8) A method of building a box girder of a box girder bridge, which includes the steps of disposing outer cables each having a transparent sheath to install tendons for prestressing the box girder, and injecting a grout into the sheath while observing and inspecting the filling condition in the sheath from the outside thereof.

(9) A box girder building method as stated in the above paragraph (8), wherein the filling condition in the sheath covering the outer cable is observed and inspected from the outside of the sheath during the injection of the grout or after the grout has hardened.

(10) A method of building a box girder of a box girder bridge, which includes the steps of disposing outer cables each having a transparent sheath to install tendons for prestressing the box girder in the longitudinal direction of the box girder bridge, and injecting a colored grout into the sheath while observing and inspecting the filling condition in the sheath from the outside thereof.

(11) A box girder building method as stated in the above paragraph (10), wherein the filling condition in the sheath covering the outer cable is observed and inspected from the outside of the sheath during the injection of the grout or after the grout has hardened.

Other objects, features and advantages of the present invention will become apparent to those skilled in the art from the following description. It should be understood, however, that the description of the specification of this application, including the following description and specific examples, shows preferred embodiments of the present invention, and the description is for illustrative purposes only. It will become readily apparent to those skilled in the art from the following description and knowledge from other portions of this specification that various changes and/or alterations (modifications) may be made without departing from the spirit or scope of the present invention disclosed in this specification.

EXPLANATION OF REFERENCE NUMERALS

Figure 1:
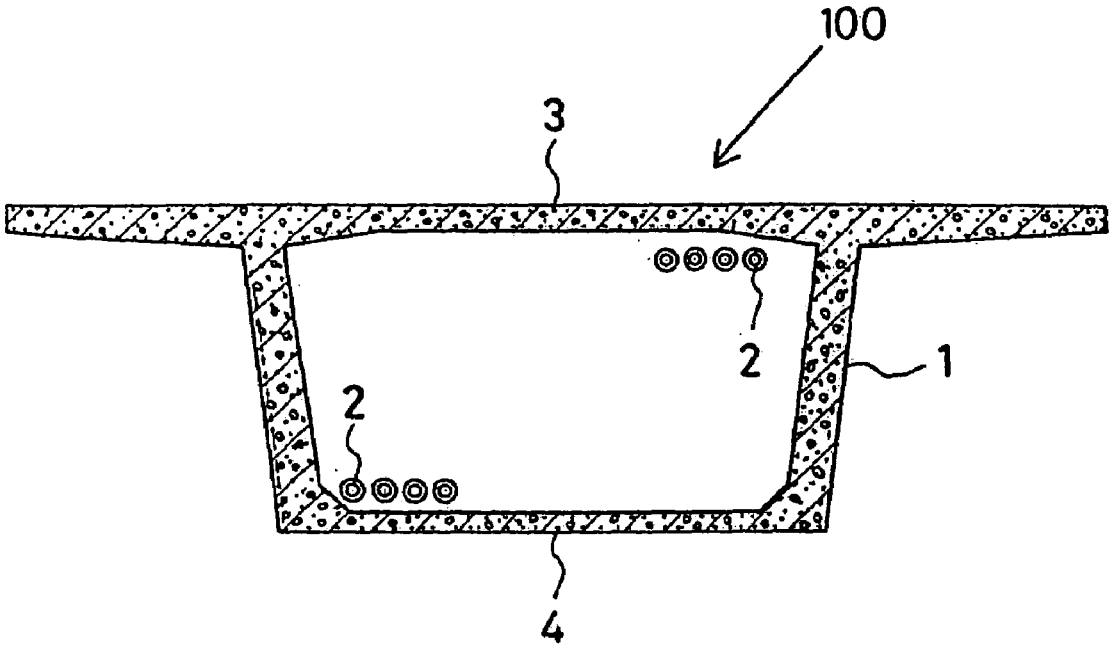
FIG. 1 is a sectional view of a box girder bridge provided with outer cables.

In the drawings: reference numeral 1 denotes a web; 2 denotes outer cables; 3 denotes an upper floor slab (flange); 4 denotes a lower floor slab (flange); 5 denotes deflectors; 5' denotes through-holes; 6 denotes anchorages; 7 denotes a transparent sheath; 8 denotes a tendon; 9 denotes a grout; 10 denotes a grout injection pipe connecting opening; 11 denotes a drainage hose connecting opening; 71 denotes a spiral crest portion; 72 denotes a spiral shallow groove portion (root portion); 12 denotes diabolos (curved steel pipes); 13 denotes sheath joints; and 100 denotes a box girder.

BEST MODE FOR CARRYING OUT THE INVENTION

The present invention provides a box girder structure including outer cables disposed in a box girder of a box girder bridge to prestress the box girder, wherein each outer cable is disposed in a transparent sheath so that inspection during injection of a grout into the sheath or inspection of the condition in the sheath and refilling of the grout into a vacant space in the sheath can be performed reliably and easily, and also provides a method of building the box girder structure.

Figure 6:
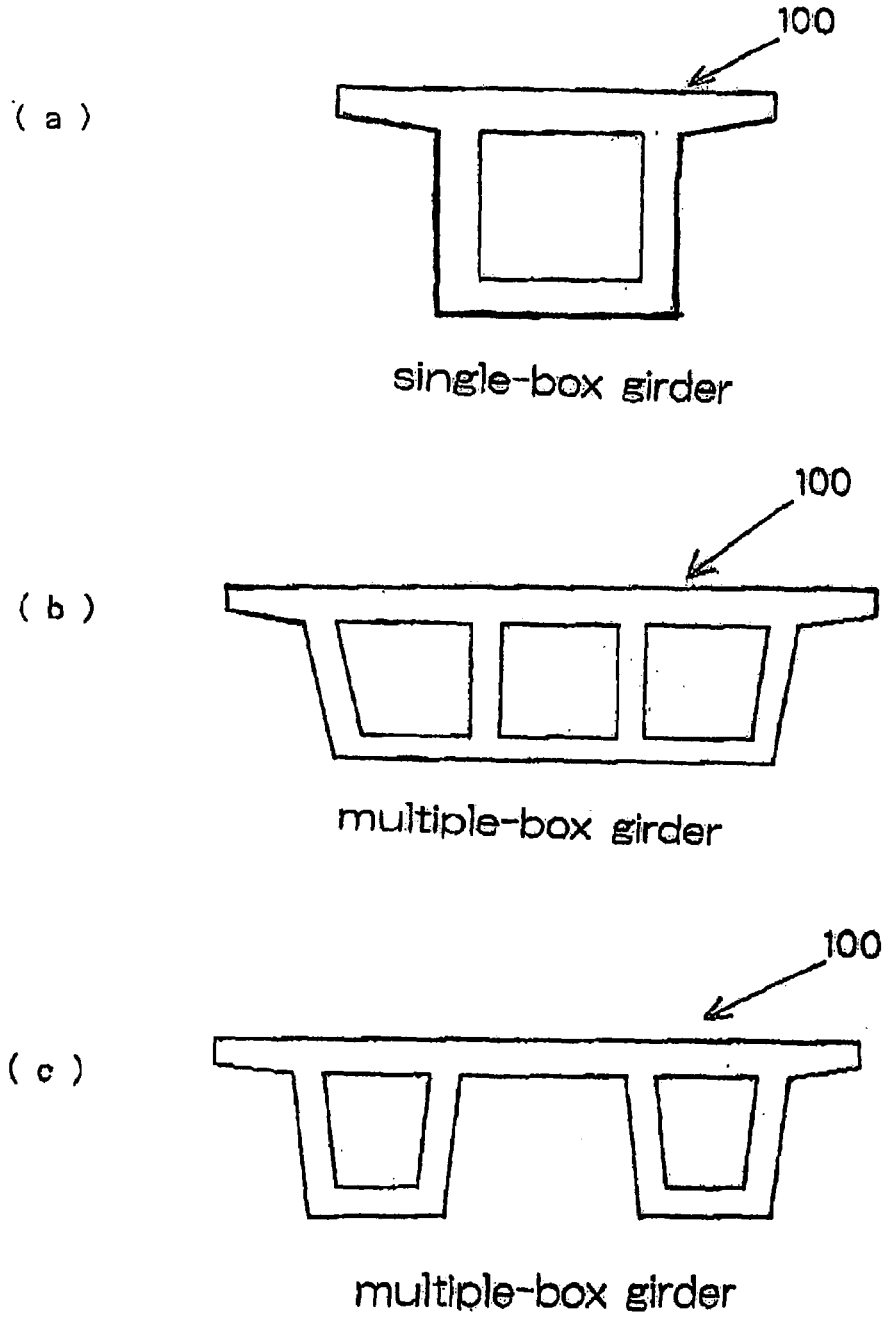
FIG. 6 show the sectional configurations of typical box girder structures, in which: part (a) is a sectional view of a single-box girder; part (b) is a sectional view of a multiple-box girder; and part (c) is a sectional view of another multiple-box girder having a different configuration.

In this specification, the term "box girder" means, as shown in FIG. 1, a beam having a box-shaped cross-section (hollow closed cross-section) 100 formed by upper and lower flanges 3 and 4 and vertical or slant webs 1 joining the flanges 3 and 4. Examples of the box girder 100 include a single-box girder and a multiple-box girder. Parts (a), (b) and (c) of FIG. 6 show examples of the sectional configurations of such box girders. However, the present invention is not necessarily limited to the illustrated box girders but may include any bridge structure suitable for disposing outer cables for prestressing.

In this specification, the term "box girder bridge" means a bridge of the type in which a box girder is supported by abutments or piers. However, there is no particular restriction on the type of bridge. The present invention may include any type of bridge that is known to those skilled in the art or readily available, provided that the bridge can use a transparent sheath for an outer cable for prestressing. The term "prestressing" means previously applying stress to cancel the tensile stress to concrete in a direction opposite to a direction in which tensile stress may be applied to the concrete, that is, previously applying compressive stress (tensioning force of prestressing steel that is introduced into the girder cross-section). The term "outer cable" means a cable made of steel or the like which is provided to prestress concrete. More specifically, the outer cable is provided out of the concrete member in cross-section of a girder (i.e. in the space inside the box girder cross-section).

In this specification, the term "transparent" used in the term "transparent sheath" means, for example, that the filling condition of a grout being filled into the sheath can be visually observed from the outside of the sheath. It is possible to use a sheath having any property as long as it performs the above-described function. The term "transparent sheath" may mean a sheath having light transmission properties, for example. Light in this case may mean visible light. The term "sheath" means a hollow, typically tubular, or duct member that can pass a prestressing steel in the hollow portion thereof. The sheath performs the function of sheathing the prestressing steel extending through the hollow portion. There is no particular restriction on the shape of the sheath. It is possible to use any type of sheath that is known to those skilled in the art or readily available, provided that the selected sheath can pass a prestressing steel in the hollow portion thereof.

Embodiments of the present invention will be described below with reference to the accompanying drawings.

Figure 2:
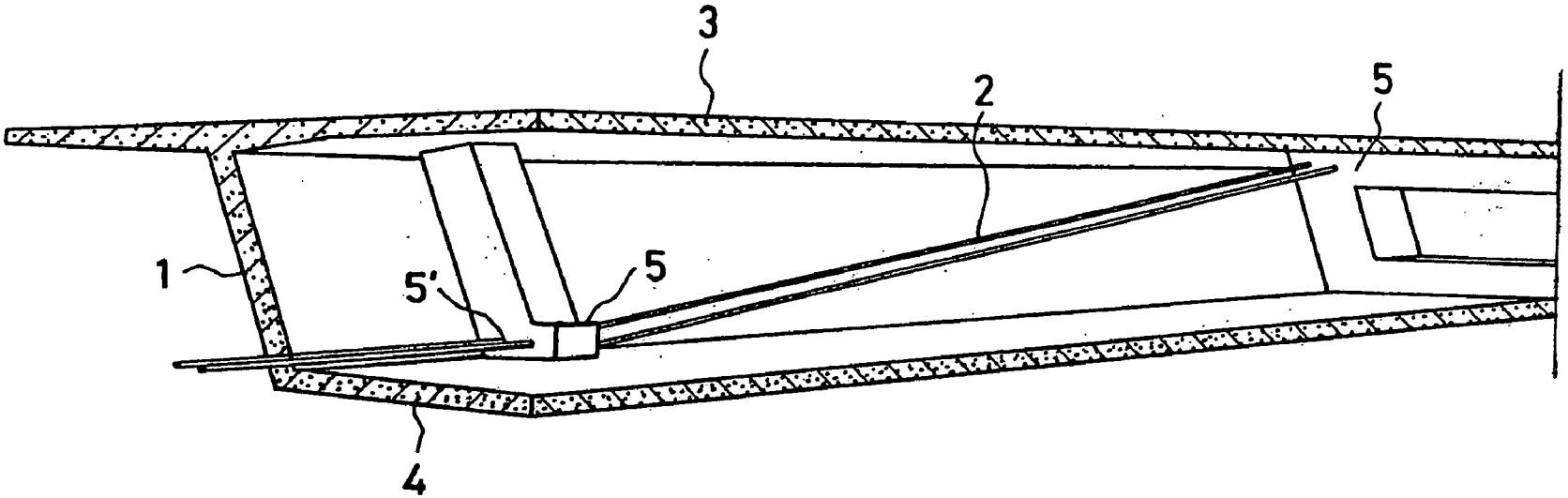
FIG. 2 is a perspective view showing the way in which the outer cables are disposed in the box girder bridge.

FIG. 1 is a sectional view of a box girder constituting a bridge, and FIG. 2 is a vertically sectioned perspective view showing a central portion of the box girder, which is partly sectioned in the longitudinal direction.

Figure 3:
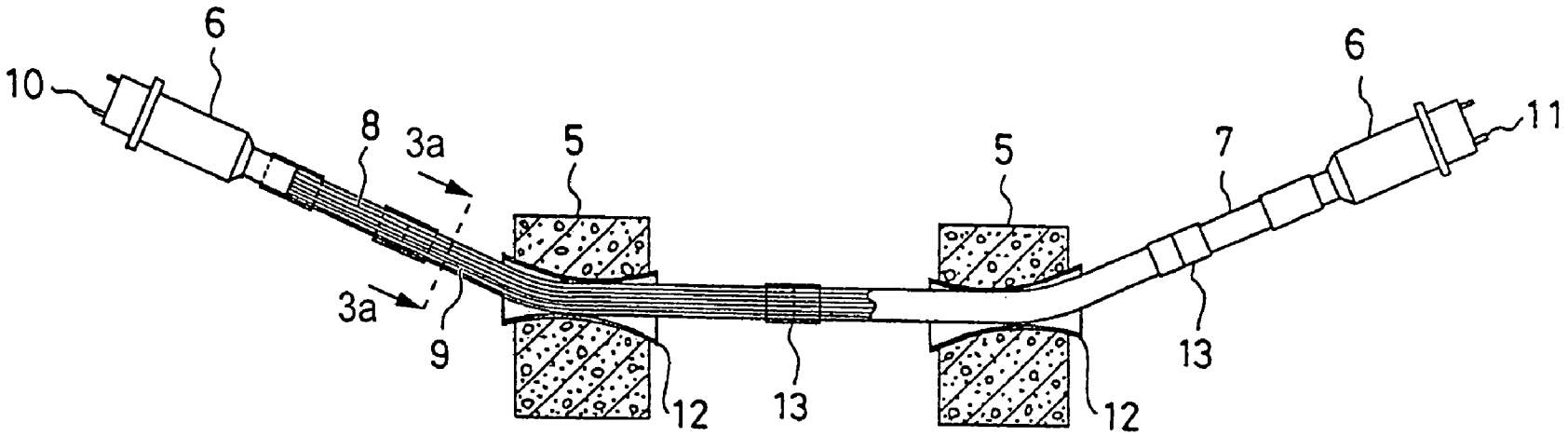
FIG. 3 is a longitudinal sectional view showing various elements present between one anchorage and the other anchorage of an outer cable.
Figure 3A:
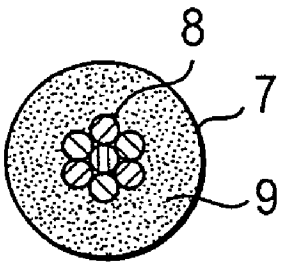
FIG. 3*a* is a cross sectional view showing the transparent sheath, the tendons and the grout.
Figure 4:
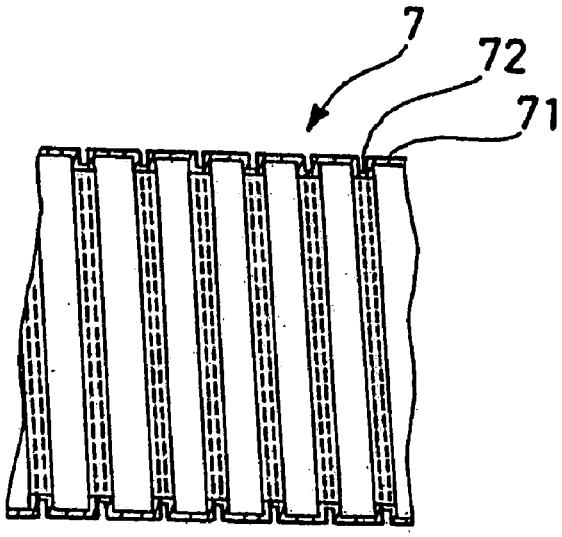
FIG. 4 is a sectional view of a sheath formed into a bellows-shaped member having a spiral shallow groove.
Figure 5:
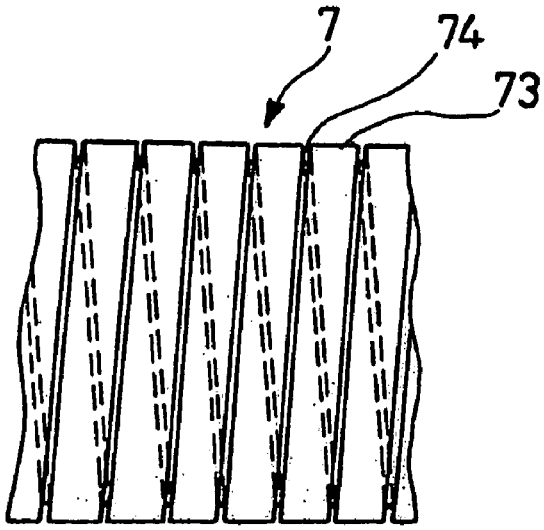
FIG. 5 is a view showing the external appearance of the sheath illustrated in FIG. 4.

FIG. 3 is a vertical sectional view showing various constituent elements present between two anchorages of a single outer cable, in which the distance between the two anchorages is reduced. FIG. 3*a* is a cross sectional view showing the transparent sheath, the tendons and the grout. FIG. 4 is a sectional view of a sheath formed into a bellows-shaped member, particularly a bellows-shaped member having a spiral shallow groove, to impart flexibility to the sheath. FIG. 5 is a view showing the external appearance of the sheath illustrated in FIG. 4. FIG. 6 show the sectional configurations of typical box girder structures, in which: part (a) is a sectional view of a single-box girder; part (b) is a sectional view of a multiple-box girder; and part (c) is a sectional view of another multiple-box girder having a different configuration.

First, as shown in FIGS. 1 and 2, a large number of outer cables 2 are disposed in the space inside the webs 1 of a box girder 100 constituting a bridge, which is formed from a concrete structure. Thus, it is possible to reduce the thickness of the webs 1 and hence possible to achieve a reduction in weight of the box girder structure.

An upper floor slab 3 is provided at the top of the box girder to form a road surface on which vehicles will drive. Concrete structures constituting deflectors 5 are provided on the side surfaces of the box girder at intervals necessary. The concrete structures are integral with the webs 1.

Each of the outer cables 2 for prestressing the box girder extends through a through-hole 5' provided in a deflector 5 to change its stretching direction and then passes through a through-hole 5' in another deflector 5 to reach an anchorage 6 at each end of the cable 2 where it is secured. The cable deflectors 5 are provided to change the cable stretching direction so as to produce prestressing forces in the vertical direction of the structure through contacting pressures at deflectors. Referring to the sectional view of a cable shown in FIG. 3, a cable used in a box girder for an ordinary bridge includes one or a plurality of prestressing steel wires or steel strands each consisting of a large number of thin steel wires, which are bundled to form a tendon 8. The tendon 8 is inserted into a sheath 7. Vacant spaces in the sheath 7 are fully filled with a grout 9. Thus, the cable looks like a thick rope. Tensioning force is applied to the cable at the anchorages 6 provided at both ends of the box girder. The tensioning force is constantly maintained even in actual use to maintain the load-carrying capacity of the concrete structure and to prevent failure due to harmful cracking or the like.

The transparent sheath 7 according to the present invention is a transparent pipe made of a transparent resin material selected from among a vinyl chloride resin material, a polyethylene resin material, a polypropylene resin material, a polycarbonate resin material, a Teflon resin material and so forth, or a composite material consisting of two or more of these materials, or other transparent materials.

A vinyl chloride pipe is suitable from the viewpoint of economy and properties. Usually, a reeled vinyl chloride pipe of continuous length (about 50 meters at maximum) is unreeled at the site of construction when installed. However, cut lengths of vinyl chloride pipe may be connected together to form the whole length of sheath at the site of construction.

In view of the installing operation at the site of construction, it is preferable to make the sheath transparent and flexible. It is particularly preferable to form the sheath into a bellows-shaped member having a spiral shallow groove as shown in FIGS. 4 and 5. By doing so, the sheath is improved in handling properties required in a bending operation and so forth. In the figures, reference numeral 71 denotes a spiral crest portion, and reference numeral 72 denotes a spiral shallow groove portion (root portion).

In the sheath 7 shown in FIGS. 4 and 5, the crest portion of the bellows-shaped member, which constitutes the sheath 7, is formed by the spiral crest portion 71, and the root portion of the bellows-shaped member is formed by the spiral shallow groove portion 72. Therefore, as grout is filled into the sheath 7 from one end thereof, air at the inner surface of the sheath pipe wall spirally moves toward the other end along the inner side of the spiral crest portion 71. As a result, no air collects at the inner surface of the sheath pipe wall. Accordingly, the effect of the sheath 7 further improves.

For the tendon 8 constituting the cable, it is also possible to use a fiber-reinforced plastic material, which is reinforced with reinforcing fiber, e.g. carbon fiber, in addition to steel. However, steel is often used from the viewpoint of economy. As steel used for the tendon 8, an appropriate steel material may be selected from those which are widely known to those skilled in the art as prestressing steel or from those developed for use as prestressing steel.

A plurality of deflectors 5 are provided inside the central portion of the box girder of the bridge. A curved steel pipe known as a diabolo 12 is provided in each deflector 5 for each cable. The curved steel pipe allows the cable to be brought into surface contact with the sheath 7 forming the outer surface of the cable, thereby reducing frictional resistance and thus allowing the cable to move smoothly during prestressing. It should be noted that an effective way of further reducing the frictional resistance is to form a polyethylene sheet on the surface of the diabolo 12. Contacting pressure occurring at the deflector 5 is likely to impose a load locally on sheathing enveloping the tendon 8 in the sheath 7. To prevent this problem, spacers for reducing friction are placed through the curved steel pipe. To reduce cost of material and labor transparent resin sheathing can be cast directly in concrete of the deflector.

Next, the substance of operations based on the present invention will be described.

After the outer cables 2 have been tensioned to effect prestressing and anchored at both ends of the box girder, in a typical example, an injection hose is attached to a connecting opening for grouting provided at an endmost portion 10 of the sheath 7 at the anchorage 6. Usually, cement or resin milk is used as a grout, and it is injected by using a grout pump (with a maximum capacity of about 15 atm pressure, in general). An effective way of allowing the sheath to be smoothly exhausted of air during grouting is to provide an exhaust opening in the sheath at a relatively high cable position. The condition of the grout being filled into the sheath 7 can be observed through the transparent sheath 7 at any time. Thus, it is possible to continue the operation while appropriately controlling or changing grouting conditions so that air bubbles will not remain in the sheath 7. When the injected grout has been fully filled in the sheath 7 and reached the other end of the cable, the completion of filling can be confirmed by ascertaining that a grout component has been discharged from a discharge hose connecting opening 11 provided at the anchorage 6, or finally ascertaining that the grout has been discharged from an exhaust opening separately provided at a high cable position. A vacant space occurring in the cable during use can be readily discovered by usual routine inspection performed in the box girder. If necessary, repair may be executed by locally carrying out additional grouting in the vicinity of a portion where a vacant space has occurred, thereby making it possible to improve durability and to increase the lifetime.

It is even more desirable to inject a colored grout prepared by mixing a grout with a small amount of an inorganic coloring material, e.g. chromium oxide, iron oxide, copper oxide, or manganese oxide, or an organic coloring material. By doing so, the filling condition of the grout in the transparent sheath can be grasped even more clearly. It is preferable to adjust the degree of pigmentation so that the color of the grout is not very deep but sufficiently noticeable to allow a vacant space to be readily found.

When a vacant space is found in a transparent sheath already filled with a grout, it is preferable to carry out regrouting by sticking a needle portion of an injector-shaped grouting device into the transparent sheath as far as the vacant space and injecting it with the grout.

EXAMPLE

The present invention will be described below more specifically by way of an example. It should be understood, however, that the present invention is not necessarily limited to the example but includes various embodiments.

To confirm the validity of the present invention, we carried out an actual-scale experiment. The outline of the experiment is as follows:

(1) Products Under Test

Sheath:
Transparent vinyl chloride pipe
(outer diameter: 114 millimeters;
length: 13.5 meters)

Anchorage:
Anchorage for the Anderson method
(Anderson Technology)

Steel:
Bare strands of 15.2 mm outside dia.
(19 strands of 13.5 m length)

Grout:
Portland cement mixed with Pozzolis GF-1720
(admixture; trade name)

(2) Testing Method and Results

An anchorage for the Anderson method was installed at one end of the sheath, and a water stop jig was installed at the other end of the sheath. Strands (19 strands) were inserted into the sheath. Then, the grout was injected into the sheath, and the process of injection was observed. After a collection of air had been found above deflectors, a discharge hose was opened to remove the air. After the sheath had been injected with the grout, it was possible to check the injected condition over the entire length of the sheath. Further, a colored grout was injected into the sheath. As a result, it became markedly easy to check movement of the grout in the sheath.

The above-described results proved that the application of the transparent sheath makes it possible to reliably confirm the grouting condition while following the movement of the grout in the sheath and hence possible to fill the grout fully. In particular, it was proved that inspection and confirmation can be made easily and reliably by visual observation.

It should be noted that, in the cable configuration, a portion of each cable that extends along the lower floor slab of the box girder is likely to be fully filled with the grout because air bubbles getting mixed therein during grouting and vacant spaces produced in the sheath are likely to move upwardly and be replaced by the grout. Therefore, an opaque sheath, which is less costly, can be used for the sheath at this portion.

INDUSTRIALLY APPLICABILITY

According to the present invention described above, it becomes possible to perform inspection and confirmation extremely reliably and easily when prestressing is newly done and also when the occurrence of a vacant space in cables being used is inspected and confirmed in the field of outer cables for box girder bridges where it has heretofore been difficult to grasp the filling condition of a grout in the sheath of each outer cable. In particular, when a colored grout is injected, the confirmation of the filling condition is further facilitated.

When prestressing steel is used as tendons, fully filling of a grout is indispensable for enhancing anti-corrosion effect. In this regard, because it is possible to readily discover partial fracture or other damage to tendons of various kinds, the reliability of cable maintenance is improved to a considerable extent, and the lifetime of the box girder bridge itself can be increased.

It will be apparent that the present invention can also be carried out in forms other than those stated specifically in the foregoing description and example. Various changes and modifications of the present invention may be made in light of the above-described teachings. Accordingly, such changes and modifications also fall within the scope of the appended claims.

In addition, it will be apparent that the technique of the invention in this application is applicable not only to concrete girders but also to girder structures made of steel as it is.

What is claimed is:

1. A box girder structure comprising outer cables disposed in a box girder of a box girder bridge to prestress said box girder, said outer cables each being disposed within an enclosing transparent sheath, and said outer cables being visually observable in said box girder.

2. A box girder structure according to claim 1, wherein said sheath covers the outer cable and enables reliable and ready performance of visual observation of an operation selected from the group consisting of inspection during injection of a grout into said sheath, inspection of a condition in said sheath and refilling of the grout into a vacant space in said sheath.

3. A box girder structure according to claim 1, wherein said transparent sheath is made of a material selected from the group consisting of a polyethylene resin material, a vinyl chloride resin material, a polypropylene resin material, a polycarbonate resin material and a Teflon resin material, or a composite material consisting of two or more of these materials.

4. A box girder structure according to claim 3, wherein said transparent sheath is directly cast in concrete of a deflector or a plurality of deflectors to dispose said outer cables.

5. A box girder structure according to claim 4, wherein said deflectors are provided with curved pipes to contain said outer cables.

6. A box girder structure according to claim 5, wherein said curved pipes each have an inner surface coated with polyethylene.

7. A box girder structure comprising outer cables disposed in a box girder of a box girder bridge to prestress said box girder, said outer cables each being disposed within an enclosing transparent sheath, said outer cables being visually observable in said box girder, and a colored grout injected into said transparent sheath.

8. A box girder structure according to claim 7, wherein said sheath covers the outer cable and enables reliable and ready performance through visual observation or an operation selected front the group consisting of inspection during injection of a grout into said sheath, inspection of a condition in said sheath and refilling of the grout into a vacant space in said sheath.

9. A method of building a box girder of a box girder bridge, said method comprising the steps of:

providing outer cables containing tendons housed within a transparent sheath;

disposing said outer cables to install tendons for prestressing said box girder;

tensioning said outer cables to effect prestressing of said box girder; and injecting a grout into said sheath while observing and inspecting a filling condition in said sheath from an outside thereof.

10. A method according to claim 9, wherein the filling condition in said sheath covering the outer cable is observed and inspected from the outside of said sheath during injection of the grout or after the grout has hardened.

11. A method of building a box girder of a box girder bridge, said method comprising the steps of:

providing outer cables containing tendons housed within a transparent sheath;

disposing said outer cables to install tendons for prestressing said box girder in a longitudinal direction of said box girder bridge;

tensioning said outer cables to effect prestressing of said box girder; and injecting a colored grout into said sheath while observing and inspecting a filling condition in said sheath from an outside thereof.

12. A method according to claim 11, wherein the filling condition in said sheath covering the outer cable is observed and inspected from the outside of said sheath during injection of the grout or after the grout has hardened, and if found, an unfilled portion is refilled with the grout.

* * * * *